US007576628B2

(12) United States Patent
Chen

(10) Patent No.: US 7,576,628 B2
(45) Date of Patent: Aug. 18, 2009

(54) LOW-PASS FILTER

(75) Inventor: Hsin-Ping Chen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 202 days.

(21) Appl. No.: 11/556,190

(22) Filed: Nov. 3, 2006

(65) Prior Publication Data

US 2007/0236311 A1 Oct. 11, 2007

(30) Foreign Application Priority Data

Apr. 7, 2006 (TW) ..... 95112503

(51) Int. Cl.
*H01P 1/203* (2006.01)

(52) U.S. Cl. ..... 333/204; 333/219

(58) Field of Classification Search ..... 303/204, 303/219, 219.1, 219.2; 333/204, 219, 219.1, 333/219.2

See application file for complete search history.

(56) References Cited

U.S. PATENT DOCUMENTS 5,291,161 A * 3/1994 Saka ..... 333/204
6,614,329 B1 * 9/2003 Woods et al. ..... 333/204
6,823,201 B2 11/2004 Kai et al.
2005/0012567 A1 * 1/2005 Liu ..... 333/185

* cited by examiner

*Primary Examiner*—Benny Lee
*Assistant Examiner*—Gerald Stevens
(74) *Attorney, Agent, or Firm*—Wei Te Chung

(57) ABSTRACT

A low-pass filter (10) is provided. The low-pass filter includes an input part (100), an output part (120), a high impedance part (140), a first low impedance part (160), and a second low impedance part (180). The input part is electronically connected to the high impedance part for input of electromagnetic signals thereinto. The output part is electronically connected to the high impedance part for output of electromagnetic signals therefrom. The input part and the output part are asymmetrical to a resonator defined by the high impedance part, the first low impedance part and the second low impedance part. One end of the high impedance part is electronically connected to the first low impedance part, the other end of that is electronically connected to the second low impedance part. Wherein the high impedance part is disposed partly between the first low impedance part and the second low impedance part.

15 Claims, 2 Drawing Sheets

LOW-PASS FILTER

BACKGROUND OF THE INVENTION

1. Field of the Invention

The present invention generally relates to a filter, and more particularly to a low-pass filter.

2. Description of Related Art

In recent years, there has been a significant growth in WLAN (wireless local area network) technology due to the ever growing demand of wireless communication products. Such growth becomes particularly prominent after promulgation of IEEE 802.11 WLAN protocol in 1997. IEEE 802.11 WLAN protocol not only offers many novel features to current wireless communications, but also provides a solution of enabling two wireless communication products manufactured by different companies to communicate with each other. As such, the promulgation of IEEE 802.11 WLAN protocol is a milestone in the development of WLAN. Moreover, IEEE 802.11 WLAN protocol ensures that a core product is the only solution of implementing a single chip. Thus, IEEE 802.11 WLAN protocol can significantly reduce the cost of adopting wireless technology so as to enable WLAN to be widely employed in various wireless communication products.

Filters are necessary components of the wireless communication products. Some manufacturers in the art use a waveguide element, such as a microstrip, to act as a filter. The microstrip filter is formed on a printed circuit board of the wireless communication product to diminish harmonic electromagnetic signals. Generally, the wireless communication product is designed to be as small as practicable. Since filters are necessary components of wireless communication products, an approach to reduce the size of a wireless communication product is to reduce the size of the filters used therein.

Therefore, a heretofore unaddressed need exists in the industry to reduce the size of filters used in the wireless communication product.

SUMMARY OF THE INVENTION

A low-pass filter is provided. The low-pass filter includes an input part, an output part, a high impedance part, a first low impedance part, and a second low impedance part. The input part is electronically connected to the high impedance part for input of electromagnetic signals thereinto. The output part is electronically connected to the high impedance part for output of electromagnetic signals therefrom. The input part and the output part are asymmetrical to a resonator defined by the high impedance part, the first low impedance part, and the second low impedance part. One end of the high impedance part is electronically connected to the first low impedance part, and the other end is electronically connected to the second low impedance part. Wherein the high impedance part is disposed partly between the first low impedance part and the second low impedance part.

Other objectives, advantages and novel features of the present invention will be drawn from the following detailed description of preferred embodiments of the present invention with the attached drawings, in which:

DETAILED DESCRIPTION OF THE INVENTION

Figure 1:
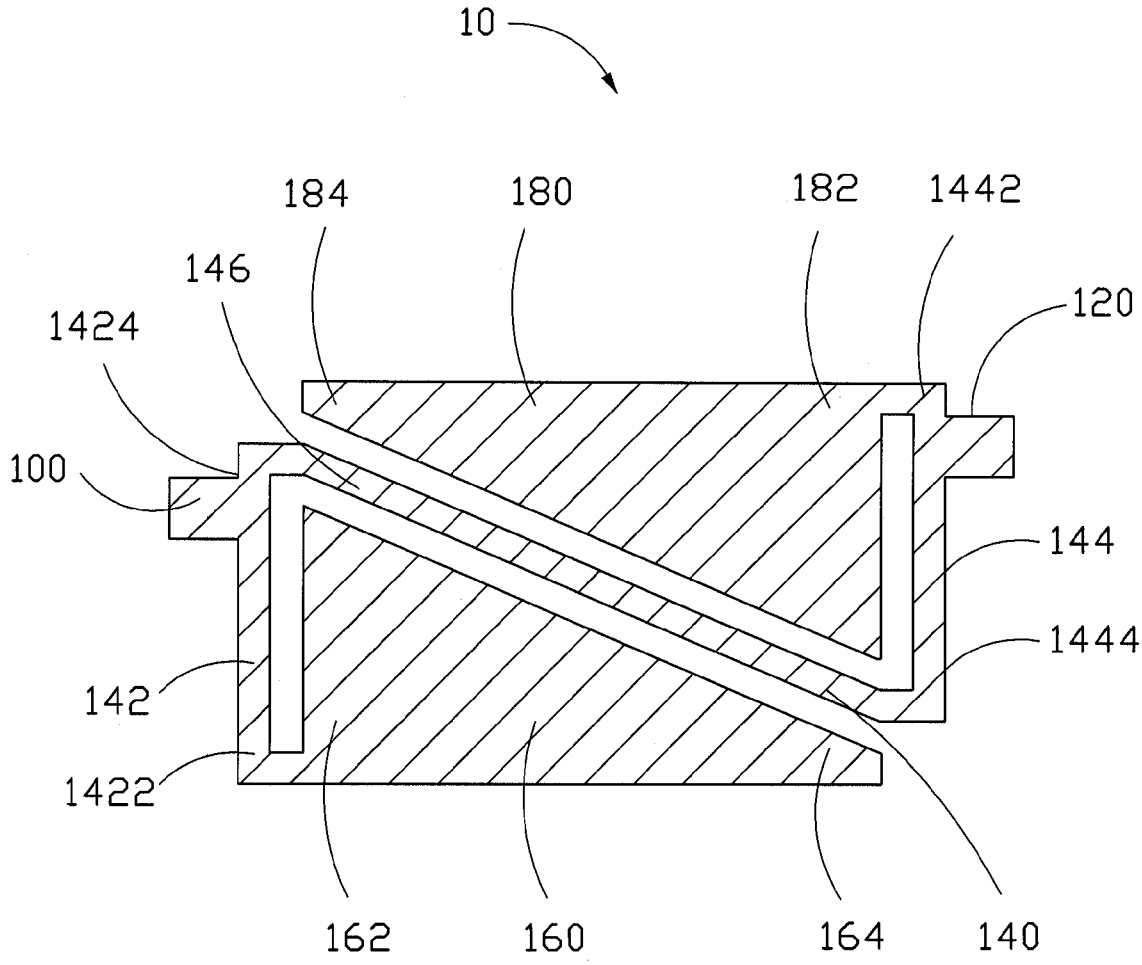
FIG. 1 is a schematic diagram of a low-pass filter of an exemplary embodiment of the invention.

FIG. 1 is a schematic diagram of an exemplary low-pass filter 10 of the present invention.

The low-pass filter 10 is provided for cutting out harmonic electromagnetic signals, and includes an input part 100, an output part 120, a high impedance part 140, a first low impedance part 160, and a second low impedance part 180.

The input part 100 is electronically connected to the high impedance part 140 for input of electromagnetic signals thereinto. The output part 120 is electronically connected to the high impedance part 140 for output of electromagnetic signals therefrom. The input part 100 and the output part 120 respectively have impedance values of approximately 50 ohms, and are asymmetrical to a resonator defined by the high impedance part 140, the first low impedance part 160, and the second low impedance part 180.

The high impedance part 140 is disposed partly between the first low impedance part 160 and the second low impedance part 180. One end of the high impedance part 140 is electronically connected to the first low impedance part 160, and the other end is electronically connected to the second low impedance part 180.

The high impedance part 140 includes a first transmission portion 142, a second transmission portion 144, and a third transmission portion 146. The second transmission portion 144 is disposed parallel to the first transmission portion 142. The third transmission portion 146 is electronically connected to the first transmission portion 142 and the second transmission portion 144, and is disposed aslant therebetween.

The first transmission portion 142 includes a first feed-in end 1422 electronically connected to the first low impedance part 160, and a second feed-in end 1424 electronically connected to the third transmission portion 146. The second transmission portion 144 includes a third feed-in end 1442 electronically connected to the second low impedance part 180, and a fourth feed-in end 1444 electronically connected to the third transmission portion 146.

The first feed-in end 1422 is centrosymmetric to the third feed-in end 1442, and the second feed-in end 1424 is centrosymmetric to the fourth feed-in end 1444.

In this exemplary embodiment, the input part 100 is formed near and electronically connected to the second feed-in end 1424, and the output part 120 is formed near and electronically connected to the third feed-in end 1442. Therefore, the input part 100 and the output part 120 are asymmetrical to the resonator defined by the high impedance part 140, the first low impedance part 160, and the second low impedance part 180. In other exemplary embodiments, the input part 100 can also be electronically connected to the first feed-in end 1422, and the output part 120 can also be electronically connected to the fourth feed-in end 1444.

The first low impedance part 160 and the second low impedance part 180 are symmetrical to the third transmission portion 146. The first low impedance part 160 includes a first connected end 162 electronically connected to the first transmission portion 142, and a first free end 164.

The second low impedance part 180 includes a second connected end 182 electronically connected to the second transmission portion 144, and a second free end 184.

In this exemplary embodiment, a width of the input part 100 and a width of the output part 120 is 0.43 mm. The high impedance part 140 has a width of 0.23 mm, and a length of 10.63 mm. A distance between the first transmission portion 142 and the first low impedance part 160 is 0.28 mm. A distance between the second transmission portion 144 and the second low impedance part 180 is 0.28 mm. A distance between the third transmission portion 146 and the first low impedance part 160 is 0.28 mm. A distance between the third transmission portion 146 and the second low impedance part 180 is 0.28 mm. A length of the first transmission portion 142 and a length of the second transmission portion 144 is 3.05 mm. A length of the third transmission portion 146 is 4.53 mm.

Figure 2:
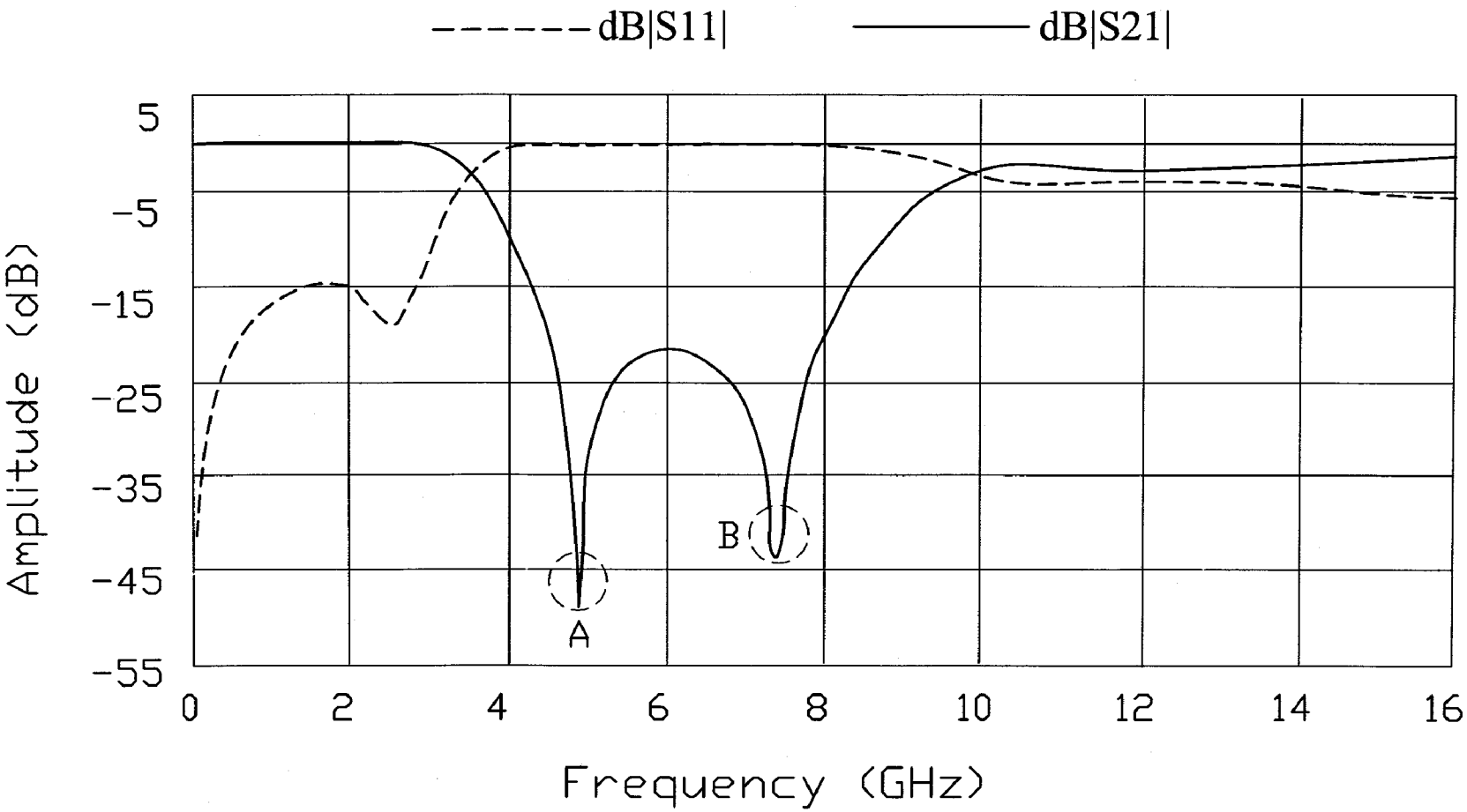
FIG. 2 is a graph of a curve showing a relationship between insertion-or-return loss and frequency of electromagnetic signals traveling through the low-pass filter.

FIG. 2 is a graph showing a relationship between an insertion or return loss and a frequency of an electromagnetic signal traveling through the low-pass filter 10. The horizontal axis represents the frequency (in GHz), and the vertical axis represents the insertion or return loss (in dB) of the low-pass filter 10. The insertion loss of an electromagnetic signal traveling through the low-pass filter 10 is indicated by the curve labeled S21 and indicates a relationship between input power and output power of the electromagnetic signals traveling through the low-pass filter 10, and is represented by the following equation:

$$\text{Insertion Loss}=-10*\text{Log}\,[(\text{Input Power})/(\text{Output Power})]$$

When the electromagnetic signals travel through the low-pass filter 10, a part of the input power is returned to a source of the electromagnetic signals. The part of the input power returned to the source of the electromagnetic signal is called return loss. The return loss of an electromagnetic signal traveling through the low-pass filter 10 is indicated by the curve labeled S 11 and indicates a relationship between the input power and the return power of the electromagnetic signal traveling through the low-pass filter 10, and is represented by the following equation:

$$\text{Return Loss}=-10*\text{Log}\,[(\text{Input Power})/(\text{Return Power})]$$

For a filter, when the output power of the electromagnetic signal in a low-pass filter frequency range is close to the input power thereof, and the return power of the electromagnetic signal is small, it means that a distortion of the electromagnetic signal is small and the performance of the low-pass filter is good. That is, the less the absolute value of the insertion loss of the electromagnetic signal is, the greater the absolute value of the return loss thereof is, and the better the performance of the filter is. As shown in FIG. 2, the absolute value of the insertion loss of the electromagnetic signal in the low-pass filter frequency range is close to 0, and the absolute value of the return loss of the electromagnetic signal is greater than 10, therefore the low-pass filter 10 has good performance. Furthermore, as shown in FIG. 2, transmitting zero points A and B are close to the pass band of the low-pass filter 10 to suppress noise signals of stop band.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A low-pass filter comprising:

a high impedance part comprising a first transmission portion, a second transmission portion disposed parallel to the first transmission portion, and a third transmission portion electronically connectable between the first transmission portion and the second transmission portion and extending aslant relative to the first and second transmission portions;

an input part electronically connected to the high impedance part for input of electromagnetic signals thereinto;

an output part electronically connected to the high impedance part for output of electromagnetic signals therefrom;

a first low impedance part electronically connected to one end of the high impedance part; and a second low impedance part electronically connected to the other end of the high impedance part;

wherein the high impedance part is partly disposed between the first low impedance part and the second low impedance part; and the input part and the output part are asymmetrical to a resonator defined by the high impedance part, the first low impedance part, and the second low impedance part.

2. The low-pass filter as recited in claim 1, wherein the input part and the output part have impedance values of approximately 50 ohms.

3. The low-pass filter as recited in claim 1, wherein the first low impedance part and the second low impedance part are symmetrical to the third transmission portion.

4. The low-pass filter as recited in claim 1, wherein the first transmission portion comprises a first feed-in end electronically connected to the first low impedance part.

5. The low-pass filter as recited in claim 4, wherein the first transmission portion further comprises a second feed-in end electronically connected to the third transmission portion.

6. The low-pass filter as recited in claim 5, wherein the second transmission portion comprises a third feed-in end electronically connected to the second low impedance part.

7. The low-pass filter as recited in claim 6, wherein the second transmission portion further comprises a fourth feed-in end electronically connected to the third transmission portion.

8. The low-pass filter as recited in claim 7, wherein the first feed-in end is centrosymmetric to the third feed-in end, and the second feed-in end is centrosymmetric to the fourth feed-in end.

9. The low-pass filter as recited in claim 7, wherein the input part is electronically connected to the second feed-in end, and the output part is electronically connected to the third feed-in end.

10. The low-pass filter as recited in claim 7, wherein the input part is electronically connected to the first feed-in end, and the output part is electronically connected to the fourth feed-in end.

11. The low-pass filter as recited in claim 1, wherein the first low impedance part comprises a first connected end electronically connected to the first transmission portion, and a first free end.

12. The low-pass filter as recited in claim 1, wherein the second low impedance part comprises a second connected end electronically connected to the second transmission portion, and a second free end.

13. A filter comprising:

an input part of said filter for input of electromagnetic signals into said filter;

an output part of said filter spaced from said input part for output of said electromagnetic signals out of said filter;

a high impedance part of said filter extending between said input part and said output part, said high impedance part comprising a first transmission portion electrically connectable with said input part to receive said input electromagnetic signals from said input part, a second transmission portion, extending spaced from and parallel to said first transmission portion, electrically connectable with said output part to transmit said electromagnetic signals to said output part, and a third transmission portion electrically connectable between said first and second transmission portions and extending aslant relative to said first and second transmission portions; and at least one low impedance part electrically connectable with a selective one of said first and second transmission portions and extending beside said third transmission portion and spaced from said third transmission portion.

14. The filter as recited in claim 13, wherein said at least one low impedance part comprises a first low impedance part electrically connectable with said first transmission portion and a second low impedance part electrically connectable with said second transmission portion, said first and second low impedance parts extend to sandwich said third transmission portion of said high impedance part between said first and second low impedance parts.

15. A filter comprising:

an input part of said filter for input of electromagnetic signals into said filter;

an output part of said filter spaced from said input part for output of said electromagnetic signals out of said filter;

a high impedance part of said filter extending and electrically connectable between said input and output parts, and comprising a slantwise transmission portion relative to said input and output parts extending between said input and output parts;

a first low impedance part electrically connectable with one end of said high impedance part and extending beside said slantwise transmission portion of said high impedance part; and a second low impedance part electrically connectable with the other end of said high impedance part and extending beside said slantwise transmission portion of said high impedance part opposite to said first low impedance part in order to sandwich said transmission portion between said first and second low impedance parts.

* * * * *